US007063125B2

(12) United States Patent
Tembreull et al.

(10) Patent No.: US 7,063,125 B2
(45) Date of Patent: Jun. 20, 2006

(54) FAN PENETRATION FEATURE FOR IN-VEHICLE TESTING

(75) Inventors: Thomas Tembreull, Marshall, MI (US); Benjamin Sprygada, Battle Creek, MI (US)

(73) Assignee: BorgWarner Inc., Auburn Hills, MI (US)

( * ) Notice: Subject to any disclaimer, the term of this patent is extended or adjusted under 35 U.S.C. 154(b) by 399 days.

(21) Appl. No.: 10/605,131

(22) Filed: Sep. 10, 2003

(65) Prior Publication Data

US 2005/0067138 A1 Mar. 31, 2005

(51) Int. Cl.
*B60H 1/00* (2006.01)

(52) U.S. Cl. ..... 165/41; 165/51; 165/121; 416/169 A; 416/135; 416/185; 416/205

(58) Field of Classification Search ..... 165/121, 165/122, 41, 51; 416/170 R, 204, 189, 169 A
See application file for complete search history.

(56) References Cited

U.S. PATENT DOCUMENTS 1,427,687 A * 8/1922 Johnson ..... 123/41.49
1,489,841 A * 4/1924 MacDonald ..... 416/167
2,454,182 A * 11/1948 Kampa ..... 123/41.12
4,692,053 A * 9/1987 Sampedro ..... 403/24
5,938,405 A * 8/1999 Coleman ..... 416/170 R
6,113,351 A * 9/2000 McCallum et al. ..... 416/48
6,527,516 B1 * 3/2003 Crevel ..... 416/204 R
6,644,922 B1 * 11/2003 McCallum et al. ..... 416/156
6,659,724 B1 * 12/2003 Takeuchi et al. ..... 416/185
6,790,006 B1 * 9/2004 Robb ..... 416/135
6,908,284 B1 * 6/2005 Adrian ..... 416/134 R
2005/0050985 A1 * 3/2005 Crissy ..... 74/574

* cited by examiner

*Primary Examiner*—Terrell Mckinnon
(74) *Attorney, Agent, or Firm*—Greg Dzieielewski, Esq.

(57) ABSTRACT

A fan penetration fixture consisting of a threaded shaft and a lock nut design. The fixture is designed to take the place of the fan clutch on a fan drive assembly in the vehicle being tested for a desired cooling system performance characteristic at each possible fan penetration. The threaded shaft portion of the fixture bolts to the fan hub. The desired fan is then bolted to the lock nut portion of the fixture. The lock nut can be positioned at any point along the threaded shaft to achieve a desired fan penetration.

19 Claims, 5 Drawing Sheets

FAN PENETRATION FEATURE FOR IN-VEHICLE TESTING

BACKGROUND OF INVENTION

The invention relates generally to fan drive systems and more specifically to a fan penetration feature for in-vehicle testing.

In-vehicle testing of fans and fan drives is highly desirable to optimize the cooling performance of the fan on cooling system components, such as a radiator, balanced against other performance factors such a fuel economy and power usage.

In order to obtain optimal performance for an associated fan drive and clutch system, it is desirable to alter the fan penetration within the radiator shroud during in-vehicle testing. Fan penetration, for the purposes of the present invention, is defined as the distance between the fan blades and the radiator. The greater the fan penetration, the smaller the distance between the fan leading edge of the blades and the radiator, and the deeper the fan blades are positioned within a radiator shroud and away from the fan clutch assembly. As the fan is rotated at a fixed rotational speed during in-vehicle testing, fan penetration directly affects the cooling performance characteristics of the fan by changing its proximity to the radiator.

Typically, fan penetration alteration during in-vehicle testing cycles is accomplished utilizing shims placed between the fan clutch assembly and the fan to alter the relative distance between the fan and fan clutch assembly. In order to install, or alter, the location of the shims, it is currently necessary to first cool the engine from operating temperatures prior to allowing technicians to alter fan penetration. The engine must then be warmed back up to operating temperatures to conduct the test at the next fan penetration. This process in time consuming, typically taking up to two or three hours to complete each shim alteration.

Another undesirable feature associated with the use of shims to alter fan penetration is the limited amount of fan locations achievable. Typical shims allow fan position changes of about one-quarter of an inch. Thus, fan optimization can be compromised within these parameters.

It is thus highly desirable to provide a new method for performing fan penetration alterations for in-vehicle testing that address these problems.

SUMMARY OF INVENTION

The present invention provides a method for testing cooling performance characteristics of a fan drive system at various fan penetrations during in-vehicle cooling tests. This feature allows optimal fan penetration positioning within the cooling system to be accomplished in a fraction of the time typically associated with prior art systems that utilize shims to determine optimal fan penetration. Further, the present invention allows quick changeovers without the need to cool down the engine, thereby decreasing changeover time associated with the cooling and subsequent warm-up of the engine back to operating temperatures during these tests. Also, the present invention allows for an infinitely variable fan location relative to the fan clutch assembly, as compared with systems that utilize shims and have a limited amount of potential fan penetration settings, thereby resulting in potentially more efficient fan performance than through the use of shims.

The present invention provides a fan penetration fixture consisting of a threaded shaft and a locking fan hub design. The fixture is designed to take the place of the fan clutch on a fan drive assembly in the vehicle being tested. The threaded shaft portion of the fixture bolts to the fan hub. The desired fan is then bolted to the locking fan hub portion of the fixture. The lock nut can be positioned at any point along the threaded shaft to achieve a desired fan penetration. The vehicle is then turned on and warmed to operating temperature, wherein the cooling system is then tested for a one or more cooling system performance characteristics. To alter fan penetration, simply loosen the lock nut feature, reposition the fan along the threaded shaft, and retighten the lock nut feature to a new fan penetration, wherein the vehicle is turned on and new measurements taken. The changeover is quick and easy, and may be done without first substantially cooling the vehicle's engine.

The present invention itself, together with attendant advantages, will be best understood by reference to the following detailed description, taken in conjunction with the accompanying figures.

DETAILED DESCRIPTION

Figure 1:
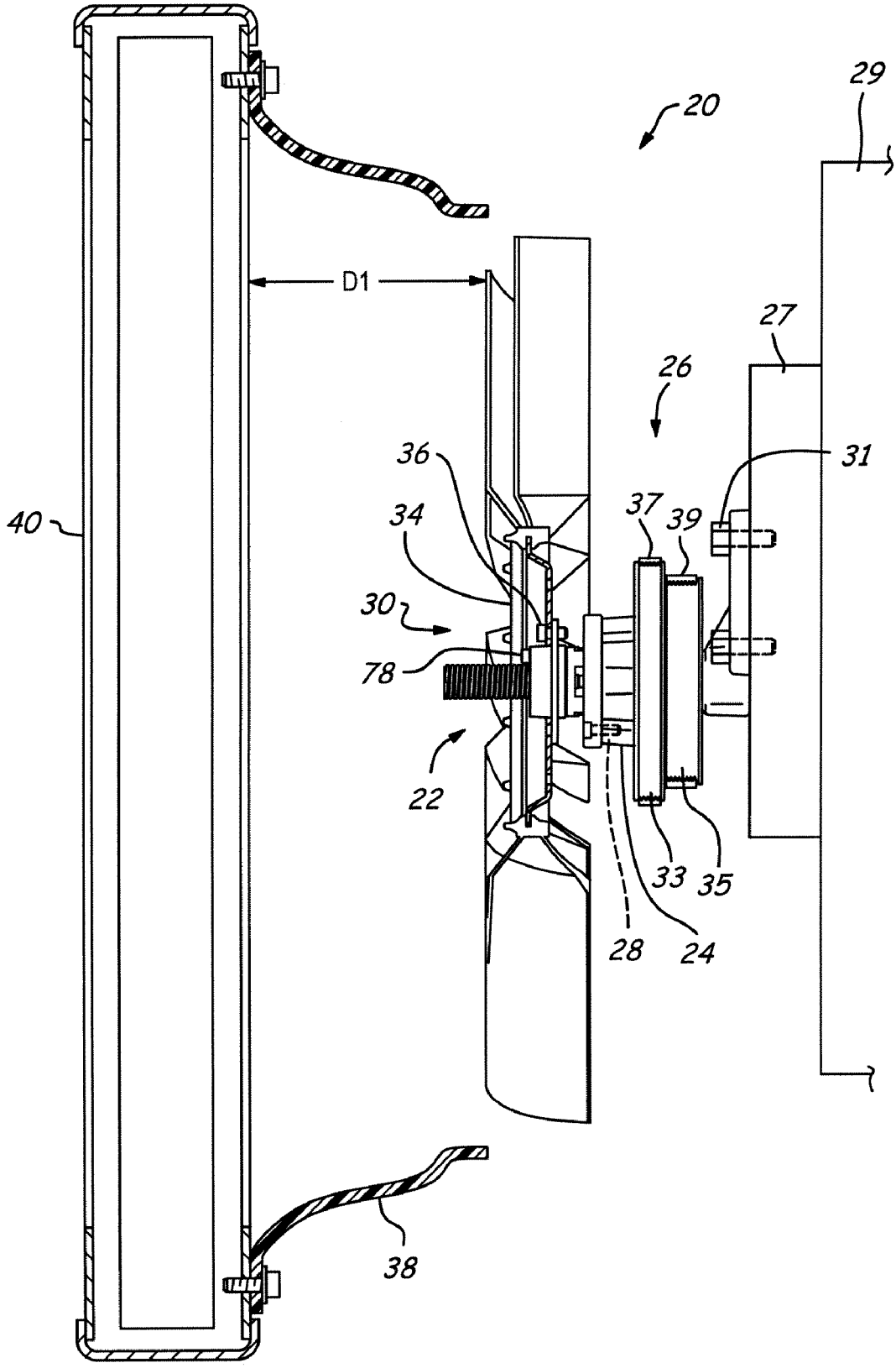
FIG. 1 is a perspective view of a cooling system having the fan penetration fixture having a first fan penetration according to one preferred embodiment of the present invention.

In the following figures the same reference numerals will be used to refer to the same components. In the following description, various operating parameters and components are described for one constructed embodiment. These specific parameters and components are included as examples and are not meant to be limiting.

Figure 2:
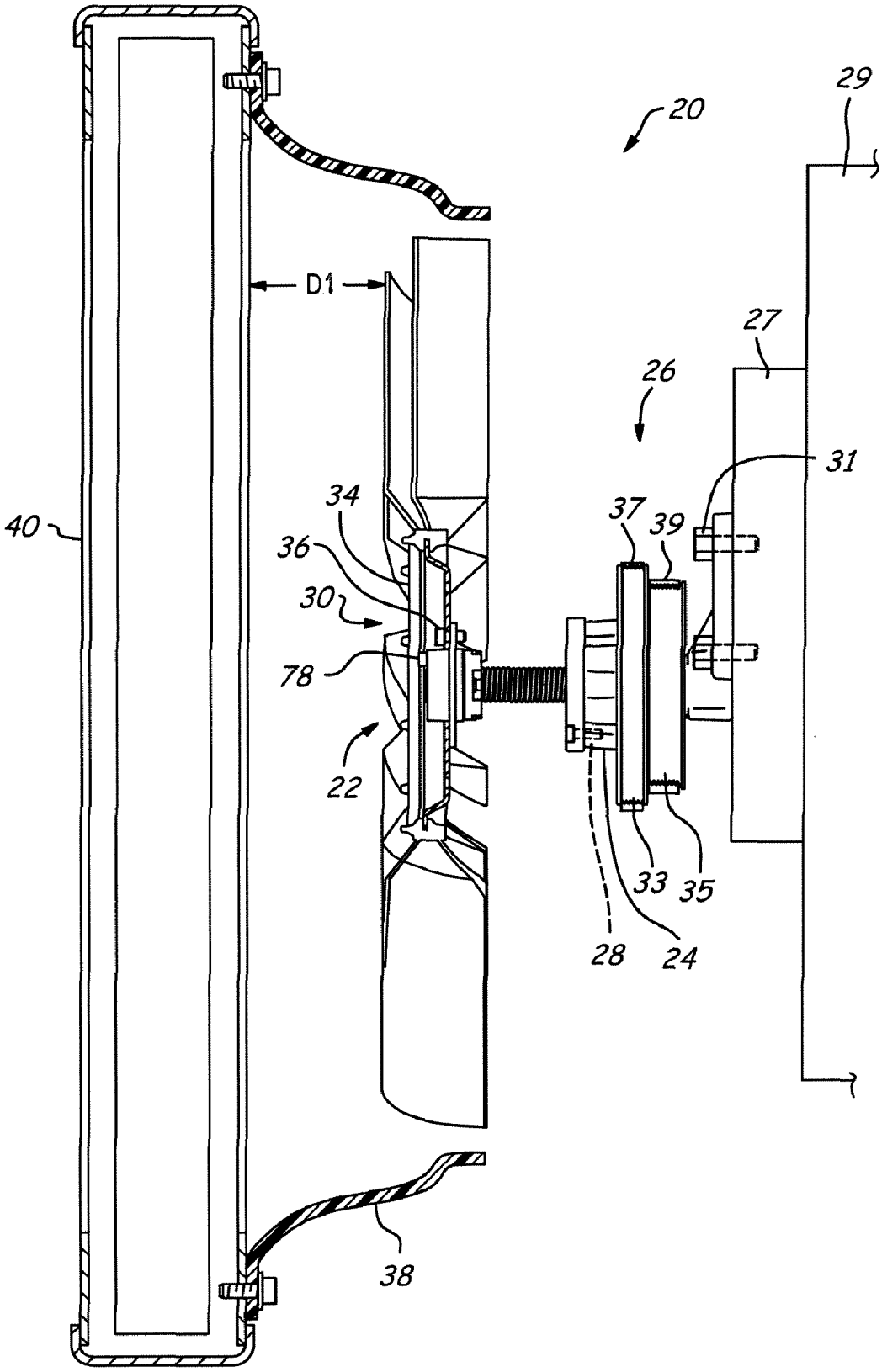
FIG. 2 is a perspective view of a cooling system of claim 1 having a second fan penetration.

Referring now to FIGS. 1 and 2, a cooling system 20 is depicted as having a fan penetration fixture 22 secured to a front portion 24 of a fan hub assembly 26 preferably using one or more socket head cap bolts 28. The fan hub assembly 26 is also coupled opposite the fan penetration fixture 22 to the FEAD (Front End Accessory Drive) bracket on the front gear case 27 of the engine 29 preferably using a series of bolts 31. The fan hub assembly 26 also has a crank pulley 33 and accessory pulley 35. A drive belt 37 is coupled to the crank pulley 33 which in turn is mounted to the engine crankshaft (not shown). A second drive belt 39 is coupled to the accessory pulley 35 and is used to drive other associated engine components such as the alternator (not shown). The drive belts 37, 39, crank pulley 33, and accessory pulley 35 thus rotate as a function of the rotational speed of the engine crankshaft.

The cooling system 20 also has a fan assembly 30 having a plurality of fan blades 32 and a hub portion 34. The hub portion 34 is preferably secured to the fan penetration fixture 22 using one or more socket head cap bolts 36 such that the fan blades 32 are positioned within a radiator shroud 38 of a radiator 40. The rotation of the engine crankshaft induces the rotation of drive belts 37, 39, which in turn rotates the hub assembly 26, fan penetration fixture 22, and hub portion 34. The rotation of the hub portion 34 then rotates fan blades 32 to cool the radiator 40.

The fan penetration fixture 22 also fixes the location of the fan blades 32 at a distance D1 relative to the radiator 40. The relative location of the fan blades 32 between the front portion 24, as defined by distance D1, is also known as fan penetration. FIGS. 1 and 2 show two separate fan penetrations, wherein distance D1 is smaller in FIG. 1 than in FIG. 2. For the purposes of the present invention, FIG. 1 is defined as having a deeper fan penetration than FIG. 2.

By varying the fan penetration, a determination of any desired cooling system performance characteristic of the fan assembly 30 to the radiator 40 can be measured for each possible fan penetration. These measurements may then be compared to determine the optimal fan penetration setting for the particular fan system 10 in a vehicle.

Figure 3:
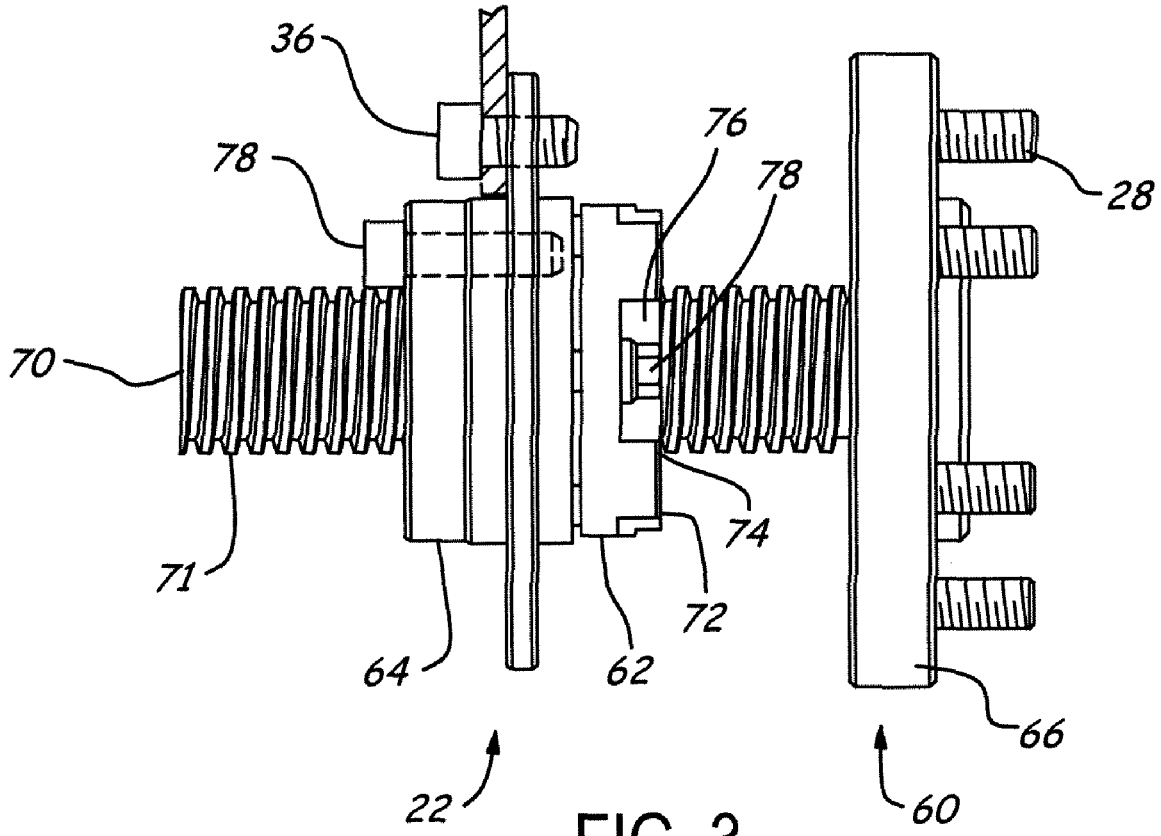
FIGS. 3 and 4 are close-up views of the fan penetration fixture of FIGS. 1 and 2.
Figure 4:
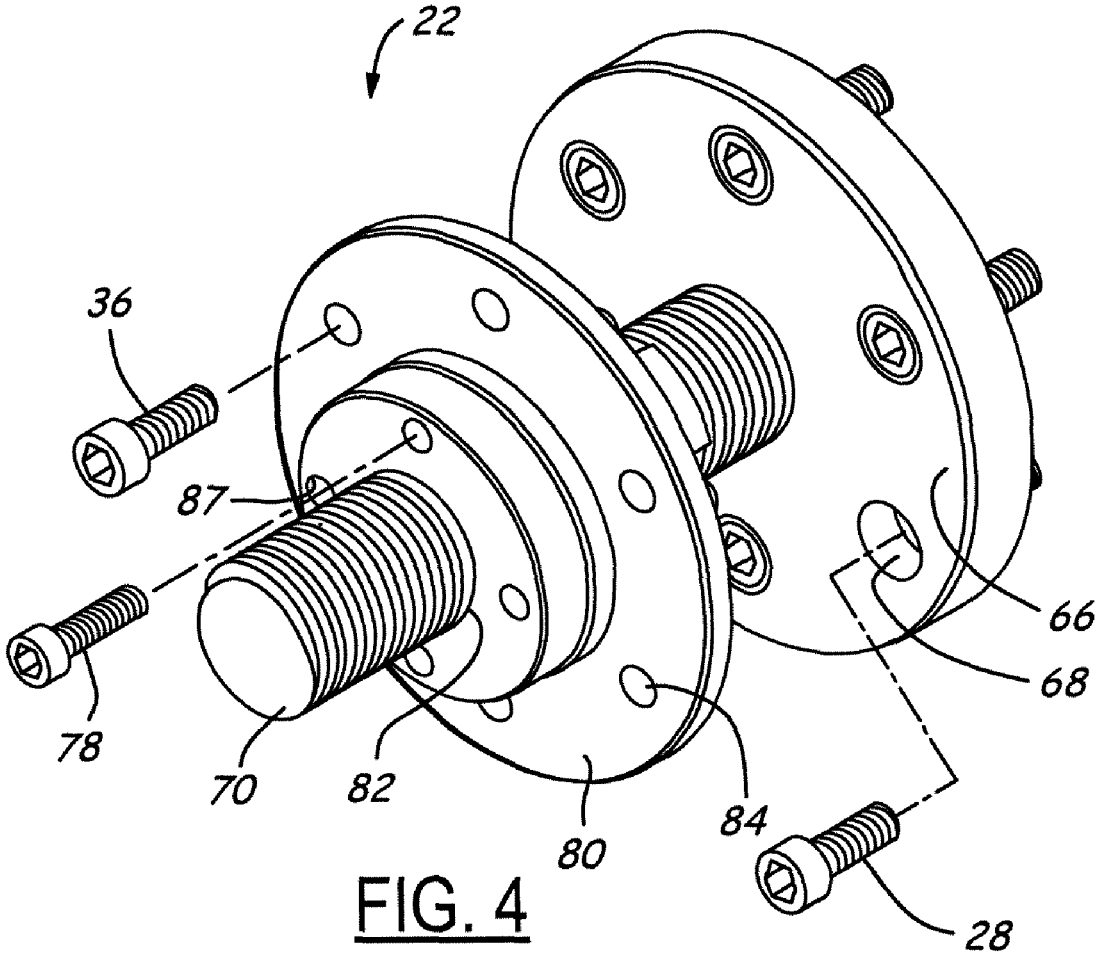

As best seen in FIGS. 3 and 4, the fan penetration fixture 22 has a threaded shaft portion 60, a locking sleeve 62, and a flanged shaft portion 64.

The threaded shaft portion 60 has a disc-shaped portion 66 preferably having one or more holes 68 used to secure the disc-shaped portion 66 to the front portion 24 using bolts 28. The bolts 28 are preferably Allen held bolts 28. In the embodiment shown in FIGS. 1–3, six holes 68 are shown placed circumferentially around the outer perimeter of the disc-shaped portion corresponding to six bolts 28. However, as one of ordinary skill recognizes, any number of bolts 28 and corresponding holes 68 may be utilized to secure the disc-shaped portion 66 to the front gear portion 24.

The threaded shaft portion 60 also has a threaded shaft 70 extending outwardly from the disc-shaped portion 66. While the threading 71 of the threaded shaft 70 is shown in FIGS. 1–3 is shown as being a left-handed thread to prevent the fan accessories (including the fan hub portion 34 and blades 32) from coming off towards the radiator 40 during testing if the locknut was loosened, it is understood by those of skill in the art the threading could also be a right-handed thread if the system was modified to prevent the accessories from coming off towards the radiator 40. The length of the threaded shaft 70 is dependent upon numerous factors, including the type of vehicle in which the fan cooling assembly 20 is used and the desired cooling performance characteristics of the fan. By varying the length of the shaft 70, multiple fan penetrations may be achieved.

The flanged shaft portion 64 has a disc-shaped body 80 surrounding an inner threaded portion 82 that corresponds to the threading on the threaded shaft 70. A series of holes 84 on the disc-shaped body 80 spaced circumferentially around the inner threaded portion 82 are used to secure the flanged shaft portion 64 to the fan hub portion 34 using bolts 36, preferably Allen head bolts 36. A second set of holes 87 are used to secure the flanged shaft portion 64 to the locking sleeve 62 as described further below. The number of holes 84 and bolts 36 that preferably secure the flanged shaft portion 64 to the hub portion 34 is shown as six in FIGS. 1–3.

The locking sleeve 62 has an outer disk 72 having an inner threaded portion 74 that corresponds to the threading on the threaded shaft 70. The locking sleeve 62 is thus twisted onto the threaded shaft 70. The outer disk 72 has a series of holes 76. A head bolt 78, preferably a 12-point flange screw, is then introduced through holes 76, 87 to secure the locking sleeve 62 to the flanged shaft portion 64 at a particular fan penetration. The tightening of the bolts 78 also locks down the locking sleeve 62 and flanged shaft portion 64 onto the threaded shaft 70, therein "locking" the fan penetration fixture 22, and the fan blades 32, at a desired fan penetration to conduct an in-vehicle test of the cooling performance characteristics. While FIGS. 3 and 4 show four holes 76, 87 containing bolts 78, it is understood that two or more respective bolts 78 and a corresponding number of holes 76, 87 may be utilized to secure the locking sleeve 62 to the flanged shaft portion 64.

Figure 5:
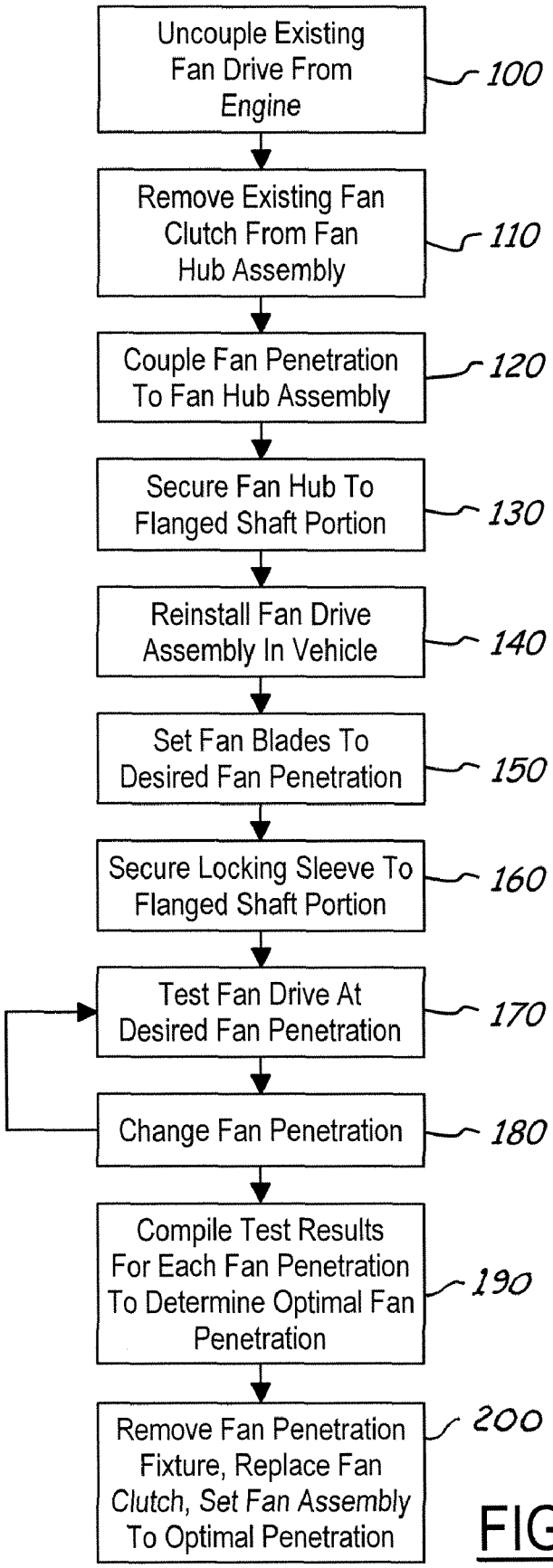
FIG. 5 is a logic flow diagram for installing the fan penetration fixture to a cooling system within a vehicle and testing the fan penetration at various fan penetrations.

FIG. 5 below illustrates a logic flow diagram for the installation and testing of the fan drive system 20 at various fan penetrations to determine to optimal fan penetration for a particular fan drive system 10.

Referring now to FIG. 5, and beginning with Step 100, an existing fan drive assembly 20 is uncoupled from the FEAD bracket on the front gear case 27 of the engine and removed from the vehicle. This is accomplished by removing the bolts 28 that secure the hub assembly 26 to the FEAD bracket on the front gear case 27. Next, in Step 110, the existing fan clutch is removed from the fan hub assembly 26 by unscrewing bolts 31.

In Step 120, a fan penetration fixture 22 is coupled to the front portion 24 of the fan hub assembly 26. This is accomplished by first coupling the bolts 31 within the corresponding holes 68 of the disc-shaped portion 66 and within holes of the front portion 24 and torquing (tightening) the bolts 31 to about 45 foot-pounds to secure the threaded shaft portion 60 to the fan hub assembly. Next, the inner threaded portion 74 of the locking sleeve 62 is screwed onto the threaded shaft 70. The inner threaded portion 82 of the flanged shaft portion 64 is then screwed onto the threaded shaft such that the disc-shaped body 80 is closely coupled to the outer disk 72 of the locking sleeve 62.

In Step 130, the fan hub portion 34, including the fan blades 32, are secured to the flanged shaft portion 64 by installing bolts 36 through the holes 84 on the disc-shaped body 80 and torquing the bolts 36 to about 8 foot-pounds.

Next, in Step 140, the entire fan drive assembly 20, including the fan penetration fixture 22, is reinstalled back into the vehicle to be tested by retightening the bolts 28 used to secure the hub assembly 26 to the FEAD bracket 27.

In Step 150, the hub portion 34 (and coupled flanged shaft portion 64 and locking sleeve 62) is rotated along the threaded shaft 70 to set the fan blades 32 at a desired fan penetration. In Step 160, bolts 78 are introduced through holes 76, 87 and tightened to about 25 foot-pounds using a torque wrench to secure the flanged shaft portion 64 to the locking sleeve 62 and "lock" the fan blades 32 at the desired fan penetration.

In Step 170, the engine is turned on, and the engine temperature is raised to a desired operating temperature range. The fan drive system 20 is set to a desired fan rotational rate by adjusting engine rpm in order to measure one or more desired cooling system performance characteristics at the particular fan penetration. As one of ordinary skill in the fan drive system industry appreciates, a wide variety of cooling system performance characteristics may be measured at the particular fan penetration. For example, engine coolant temperature may be measured at the particular fan rotation rate. Alternatively, the air temperature may be measured at various points along the surface of the radiator 40.

In Step 180, the fan penetration is changed by loosening bolts 78 and rotating the hub portion 34 to a second desired fan penetration. The bolts 78 are then retightened to 25 foot-pounds as described above in Step 160. The desired cooling system performance characteristics are again measured for the second fan penetration as in Step 170. As one of ordinary skill appreciates, Steps 170 and 180 are repeated for each desired fan penetration.

In Step 190, the measured cooling system performance characteristics for each of the various fan penetrations as determined above in Step 170 are compiled and analyzed to determine an optimal fan penetration for the particular fan drive system 20.

In Step 200, the fan penetration fixture 22 is removed and the fan clutch replaced back onto the fan drive system 20. This acquired information also allows the fan clutch assembly to then be re-designed to incorporate the optimized fan penetration determined during testing.

The present invention provides a method for testing cooling system performance characteristics for a particular fan drive system during in-vehicle cooling tests in a virtually limitless number of possible fan penetrations. This feature allows fan penetration positioning to be accomplished accurately and quickly. Further, the present invention allows quick changeovers without the need to cool down the engine for technicians between vehicle tests to perform adjustments to the fan penetration, thereby decreasing changeover time associated with the cooling and subsequent warm-up of the engine back to operating temperatures.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

The invention claimed is:

1. A method of determining an optimal fan penetration for a fan drive system used to cool an engine of a vehicle, the fan drive system having a plurality of fan blades and a closely coupled radiator, wherein fan penetration is defined as the relative location of the plurality of fan blades between the front portion of the engine and the radiator, the method comprising:

(a) uncoupling the fan drive system from the engine;

(b) removing a fan clutch from the fan drive system;

(c) coupling a fan penetration fixture to the fan drive system;

(d) recoupling the fan drive system to the engine such that the plurality of fan blades is located in a first fan penetration;

(e) measuring a desired cooling system performance characteristic of the fan drive system at said first fan penetration at a desired engine operating temperature and at a desired fan blade rotational rate;

(f) repeating step (e) for at least one additional fan penetration, wherein the location of said plurality of fan blades in said at least one additional fan penetration is not equivalent to the location of said plurality of fan blades in said first fan penetration; and (h) comparing the measured cooling system performance characteristics of the fan drive system at said first fan penetration to the measured cooling system performance characteristic at said at least one additional fan penetration.

2. The method of claim 1, wherein (c) coupling a fan penetration fixture to the fan drive system comprises:

providing a fan penetration fixture comprising a threaded shaft portion, a locking sleeve and a flanged shaft portion;

coupling said threaded shaft portion to a front portion of a hub assembly;

coupling an inner threaded portion of said locking sleeve onto a threaded shaft of said threaded shaft portion;

coupling an inner threaded portion of said flanged shaft portion onto said threaded shaft;

coupling a fan assembly to said flanged shaft portion, said fan assembly having a plurality of fan blades and a hub portion; and coupling said flanged shaft portion to said locking sleeve such that said plurality of fan blades are located at a first fan penetration.

3. The method of claim 2, wherein (f) repeating step (e) for at least one additional fan penetration comprises:

uncoupling said flanged shaft portion from said locking sleeve;

rotating said fan assembly in a first direction along said threaded shaft such that said plurality of fan blades are located at a second fan penetration; and recoupling said flanged shaft portion to said locking sleeve.

4. The method of claim 3, wherein coupling said threaded shaft portion to said front portion of said hub assembly comprises bolting said threaded shaft portion to said front portion of said hub assembly.

5. The method of claim 4, wherein bolting said threaded shaft portion to said front portion of said hub assembly comprises bolting said threaded shaft portion to said front portion of said hub assembly using at least one socket head cap bolt.

6. The method of claim 4, wherein bolting said threaded shaft portion to said front portion of said hub assembly comprises:

inserting at least one socket head cap bolt through a threaded shaft portion bolt hole and into a front portion of said hub assembly; and tightening said at least one socket head cap head bolt to about 45 foot-pounds of torque.

7. The method of claim 3, wherein coupling said flanged shaft portion to said locking sleeve comprising bolting said flanged shaft portion to a disc-shaped body of said locking sleeve such that said flanged shaft portion cannot rotate along said threaded shaft.

8. The method of claim 7, wherein bolting said flanged shaft portion to said locking sleeve comprises bolting said flanged shaft portion to a disc-shaped body of said locking sleeve using at least one 12-point flange screws such that said flanged shaft portion cannot rotate along said threaded shaft.

9. The method of claim 7, wherein bolting said flanged shaft portion to said locking sleeve comprises:

inserting at least one 12-point flange screw through a locking sleeve hole on said locking sleeve and through a flanged shaft portion hole on said flanged shaft portion; and tightening said at least one 12-point flange screw to about 25 foot-pounds of torque.

10. The method of claim 3, wherein the plurality of fan blades is located closer to the radiator in said first fan position than the plurality of fan blades in said second fan penetration.

11. The method of claim 3, wherein the plurality of fan blades are located farther from the radiator in said first fan position than the plurality of fan blades in said second fan penetration.

12. The method of claim 3, wherein said first direction is counterclockwise.

13. The method of claim 3, wherein said first direction is clockwise.

14. A fan penetration fixture for use in optimizing fan blade positioning within an engine cooling system of a vehicle for a desired cooling performance characteristic, the fan penetration fixture comprising:

a threaded shaft portion having a disc-shaped portion and a threaded shaft;

a locking sleeve threaded onto said threaded shaft; and a flanged shaft portion threaded onto said threaded shaft and coupled to said locking sleeve, wherein said flanged shaft portion has a plurality of first flanged shaft portion holes for coupling said flanged shaft portion to said locking sleeve and a plurality of second flanged shaft portion holes for coupling said flanged shaft portion to a hub portion of a fan assembly.

15. The fan penetration fixture of claim 14, wherein said locking sleeve has an outer disk having a plurality of locking sleeve holes.

16. The fan penetration fixture of claim 15 further comprising a plurality of head bolts, one of said head bolts coupled within one of said plurality of first flanged shaft portion holes and a respective one of said locking sleeve holes to secure said flanged shaft portion to said locking sleeve.

17. The fan penetration fixture of claim 16, wherein the coupling of said flanged shaft portion to said locking sleeve prevents the rotational movement of said flanged shaft portion along the length of said threaded shaft.

18. The fan penetration fixture of claim 16, wherein said plurality of head bolt comprises a plurality of 12-point flange screws.

19. The fan penetration fixture of claim 14 further comprising a plurality of Allen head bolts, one of plurality of Allen head bolts coupled within each respective one of said plurality of second flanged shaft portion holes to secure said flanged shaft portion to said hub portion of said fan assembly.

* * * * *

UNITED STATES PATENT AND TRADEMARK OFFICE

CERTIFICATE OF CORRECTION

PATENT NO. : 7,063,125 B2
APPLICATION NO. : 10/605131
DATED : June 20, 2006
INVENTOR(S) : Thomas Tembreull and Benjamin Sprygada It is certified that error appears in the above-identified patent and that said Letters Patent is hereby corrected as shown below:

On the Cover Page: Item (74)
Attorney, Agent, or Firm should read as follows: --Greg Dziegielewski, Esq.--

Signed and Sealed this

Twenty-fourth Day of July, 2007

JON W. DUDAS
*Director of the United States Patent and Trademark Office*